US006880812B2

(12) United States Patent
Nonaka

(10) Patent No.: US 6,880,812 B2
(45) Date of Patent: Apr. 19, 2005

(54) CARBURETOR

(75) Inventor: Takumi Nonaka, Iwate-ken (JP)

(73) Assignee: Zama Japan (JP)

( * ) Notice: Subject to any disclaimer, the term of this patent is extended or adjusted under 35 U.S.C. 154(b) by 130 days.

(21) Appl. No.: 10/452,675

(22) Filed: May 30, 2003

(65) Prior Publication Data

US 2004/0036184 A1 Feb. 26, 2004

(30) Foreign Application Priority Data

May 30, 2002 (JP) ..... 2002-156863

(51) Int. Cl.[7] ..... F02M 1/08

(52) U.S. Cl. ..... 261/26; 123/333; 123/352; 261/35; 261/39.1; 261/64.1; 261/65; 261/DIG. 74

(58) Field of Search ..... 261/18.3, 26, 35, 261/39.1, 64.1, 64.6, 65, 69.1, DIG. 74; 123/328, 333, 351, 352

(56) References Cited

U.S. PATENT DOCUMENTS 3,502,307 A * 3/1970 Thuesen et al. ..... 261/52
3,566,847 A * 3/1971 Scholl et al. ..... 123/492
3,690,305 A * 9/1972 Shimada et al. ..... 123/325
3,946,705 A * 3/1976 Magnuson et al. ..... 123/41.13
4,034,730 A * 7/1977 Ayres et al. ..... 123/701
4,075,988 A * 2/1978 Kato ..... 123/333
4,132,199 A * 1/1979 Kuroiwa et al. ..... 123/685
4,144,858 A * 3/1979 Bertling et al. ..... 123/454
4,168,680 A * 9/1979 Kawai et al. ..... 261/39.1
4,199,039 A * 4/1980 Ciemochowski ..... 180/177
4,344,898 A * 8/1982 Takada et al. ..... 261/39.6
4,347,196 A * 8/1982 Kenma ..... 261/39.3
4,448,734 A * 5/1984 Shibano ..... 261/26
4,517,134 A * 5/1985 Nakamura et al. ..... 261/39.2
4,572,134 A * 2/1986 Nouthuka et al. ..... 123/438
4,765,932 A * 8/1988 Muraji ..... 261/27
4,838,224 A * 6/1989 Cheng ..... 123/339.13
5,660,765 A * 8/1997 King et al. ..... 261/39.3
5,709,193 A * 1/1998 Svensson et al. ..... 123/333
6,581,916 B1 * 6/2003 Shaw ..... 261/35
6,698,727 B1 * 3/2004 Shaw ..... 261/35

FOREIGN PATENT DOCUMENTS

JP 49-17682 5/1974
JP 54-36431 * 3/1979 ..... 261/65
JP 55-69748 5/1980
JP 58-101253 6/1983

* cited by examiner

*Primary Examiner*—Richard L. Chiesa
(74) *Attorney, Agent, or Firm*—Orrick, Herrington & Sutcliffe LLP

(57) ABSTRACT

A carburetor is provided that supplies an appropriate amount of fuel at engine start-up and in a specific range of rotational speed, and allows stable engine operation at a target rotational speed. The carburetor comprises a first fuel system ($F_1$) for metering fuel from the constant fuel chamber (18) with a metering needle (32) linked to a throttle valve (5), and delivering the fuel to an air intake passage (2); and a second fuel system ($F_2$) for controlling fuel compressed by a fuel pump (8) with an electromagnetically driven control valve (52) and delivering the fuel to the air intake passage (2); by supplying pressured fuel controlled by the control valve (52) in a predetermined specific range of rotation and controlling the rotational speed during start-up and warm-up, a target rotational speed can be maintained.

96 Claims, 6 Drawing Sheets

CARBURETOR

FIELD OF THE INVENTION

The present invention relates to a carburetor for application in supplying fuel to general purpose engines, and more particularly to a carburetor that is capable of allowing stable engine operation across a broad range of operation from start-up to maximum load.

BACKGROUND OF THE INVENTION

The following devices are well known as carburetors that supply fuel to two-cycle or four-cycle general purpose engines: fixed-venturi carburetors that comprise a butterfly-type throttle valve and two fuel systems composed of a main system and a speed-reducing system as shown in Japanese Patent Application Laid-open No. 55-69748, and other publications; variable-venturi carburetors that comprise a cylindrical sliding throttle valve and a single fuel system in which the fuel delivery quantity is made variable by way of a metering needle as shown in Japanese Utility Model Publication No. 49-17682, and other publications; and carburetors that comprise a cylindrical rotating throttle valve and a single fuel system in which the fuel delivery quantity is made variable by way of a metering needle as shown in Japanese Patent Application Laid-open No. 58-101253, and other publications.

A carburetor comprising a single fuel system has well-known advantages in that the fuel passage structure is simple in comparison with one comprising a main system and a speed-reducing system, and the fuel consumption from low speeds to high speeds is smooth.

Conversely, means developed to supply a rich mixture required during engine start-up, and during low-temperature start-up in particular, include those for manually operating a start-up pump and introducing start-up fuel into the fuel system as shown in Japanese Patent Application Laid-open No. 55-69748, and other publications; and those for manually operating a throttle valve and increasing the aperture surface area of the nozzle aperture for delivering fuel that is adjusted by a metering needle as shown in Japanese Utility Model Application Laid-open No. 6-83943, and other publications.

When an engine to which fuel is supplied by the carburetor described above is operated, those components in the fuel passage extending from the constant fuel chamber and through the air intake passage of the carburetor that easily move due to engine vibrations may create inconsistencies in the fuel flow quantity. The weight of fuel in the fuel passage and in the constant fuel chamber may change due to the orientation of equipment mounted in the engine, creating inconsistencies in the fuel flow quantity. Inconsistencies in the fuel flow greatly affect the engine operating characteristics at start-up, warm-up, and other areas of operation.

However, drawbacks remain in the above-described conventional start-up fuel supply means because the feed rate may at times be inconsistent and at other times uniform, it is impossible to ensure stable warm-up even if start-up can be performed.

SUMMARY OF THE INVENTION

The present invention was developed to solve the above-described problems and is principally aimed at providing a carburetor capable of supplying predetermined fuel in any operating range of an engine, but particularly in a low range of rotation, allowing stable operation.

To solve the above-mentioned problems, the present invention includes providing, as a first means, a first fuel system having maximum flow regulating means for fuel, and mechanical fuel control means for adjusting the fuel flow in accordance with the degree of opening of a throttle valve, and for delivering fuel from a constant fuel chamber to an air intake passage; and a second fuel system having electrical fuel control means for adjusting the fuel flow rate so as to achieve a required target rotational speed of the engine in a start-up range of the degrees of opening of the throttle valve, and for delivering fuel compressed by a fuel pump to the air intake passage.

Fuel (negative pressure fuel) whose flow rate corresponds to the air intake quantity in the entire range of operation from engine start-up to full load is delivered to the air intake passage by the first fuel system. The flow rate of this negative pressure fuel is the basic flow rate set by the maximum flow regulating means and the mechanical fuel control means. Start-up and warm-up is performed with a rich mixture by a procedure in which the second fuel system delivers fuel (positive pressure fuel) to the air intake passage when the engine is started. Because the flow rate of the positive pressure fuel is adjusted by the electrical control means, the objective of allowing stable start-up, warm-up, and subsequent idling can be achieved.

According to the present invention, as a second means, a function of adjusting the fuel flow rate so as to achieve a required target rotational speed of the engine in at least one specific range of degrees of opening other than the start-up range of degrees of opening of the throttle valve is added to the electrical fuel control means of the second fuel system in the first means. Also according to the present invention, as a third means, electrical fuel control means for adjusting the fuel flow rate so as to achieve a required target rotational speed of the engine in a specific range of degrees of opening of the throttle valve is added to the first fuel system in the first means or the second means. The present invention yet further adds, as a fourth means, a manual fuel flow rate adjusting means to the second fuel system in the first, second, and third means.

Adopting these approaches allows fuel to be supplied in an appropriate amount through start-up and warm-up, allows further ease of start-up, and provides further stability during warm-up. By performing fuel flow rate control with two fuel systems in a specific range of degrees of opening of the throttle valve, the engine can be stably operated at a required target rotational speed of the engine.

Other objects and features of the present invention will become apparent from consideration of the following description taken in conjunction with the accompanying drawings.

DESCRIPTION OF THE PREFERRED EMBODIMENTS

Figure 1:
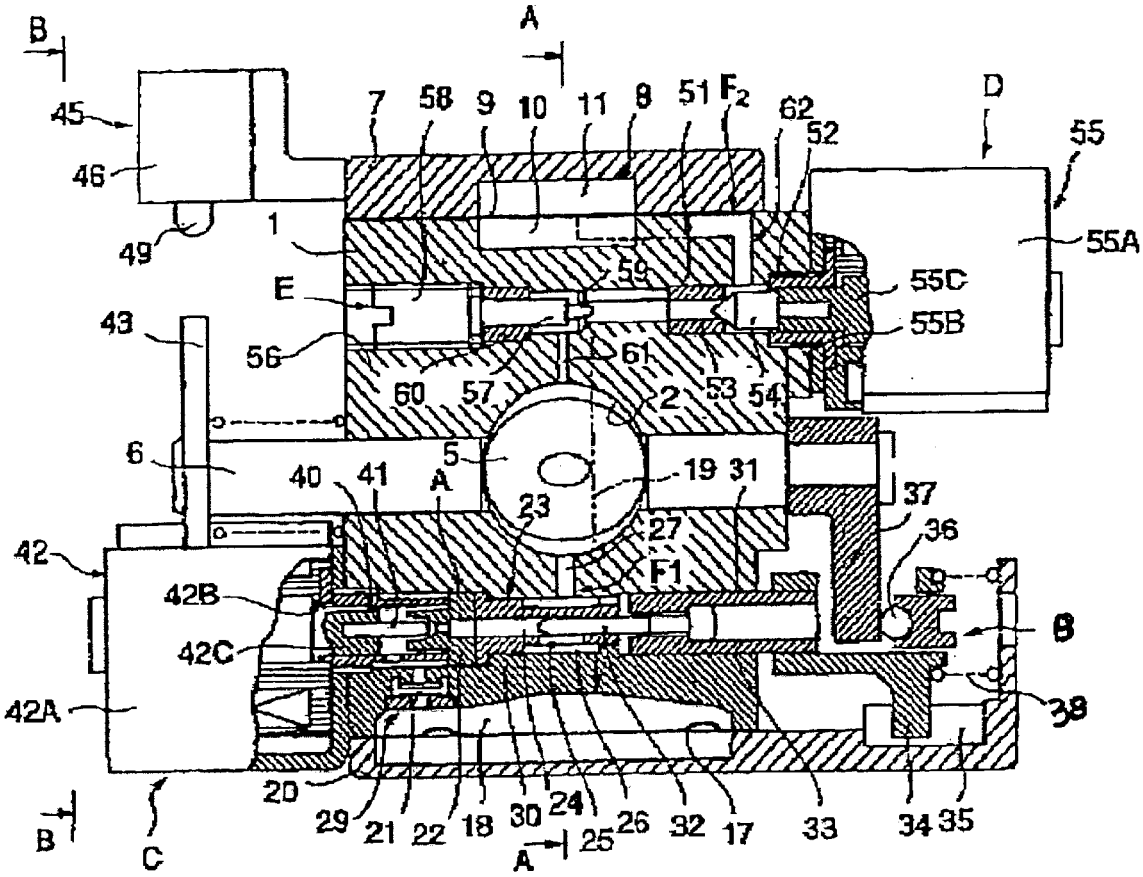
FIG. 1 is a longitudinal section showing the first embodiment of the present invention.
Figure 2:
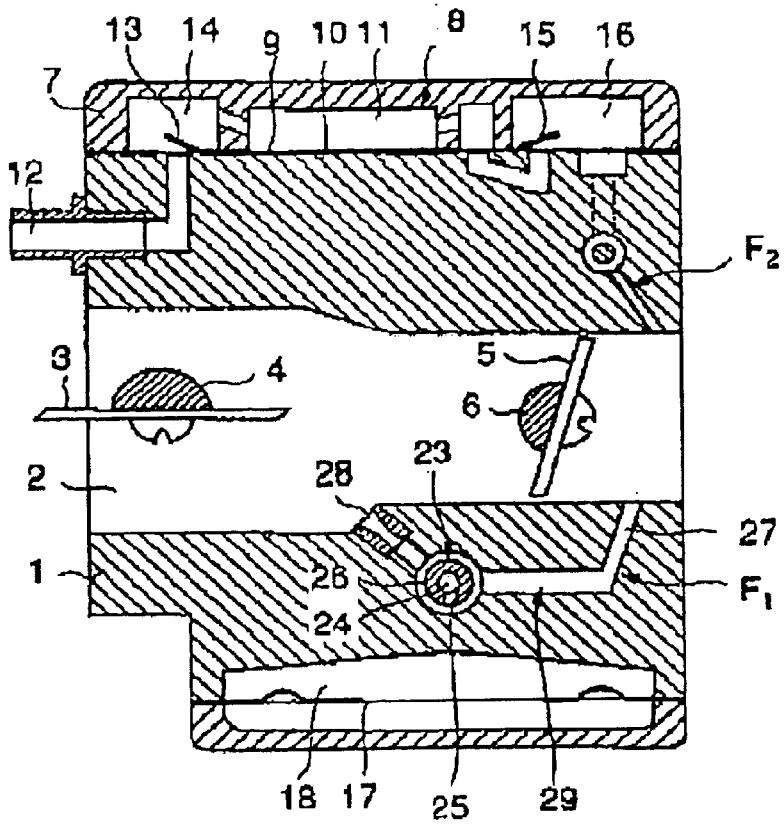
FIG. 2 is a cross section along the A—A line of FIG. 1.
Figure 3:
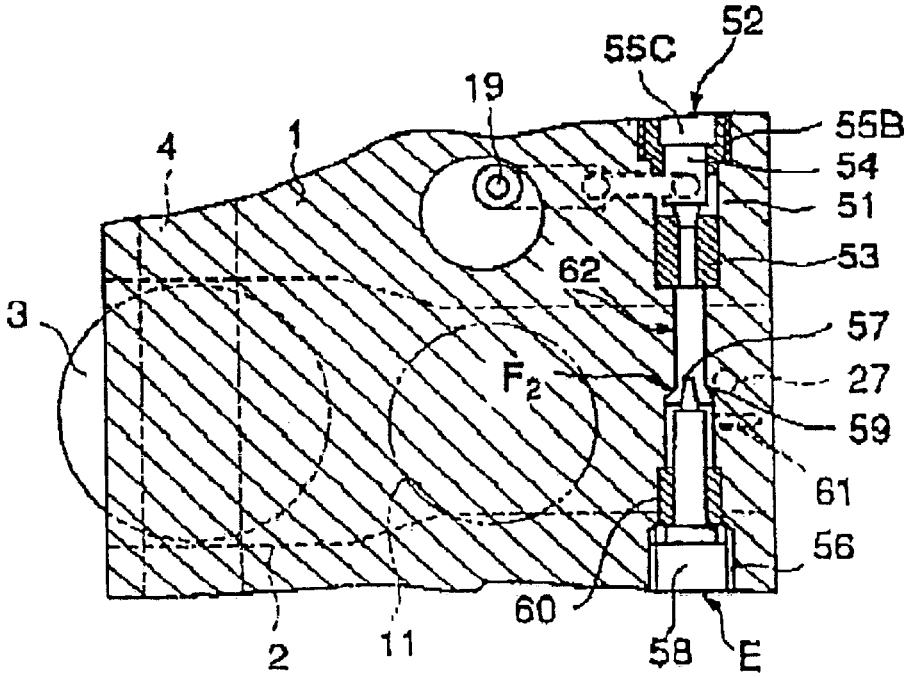
FIG. 3 is a transverse section partial view of FIG. 1.
Figure 4:
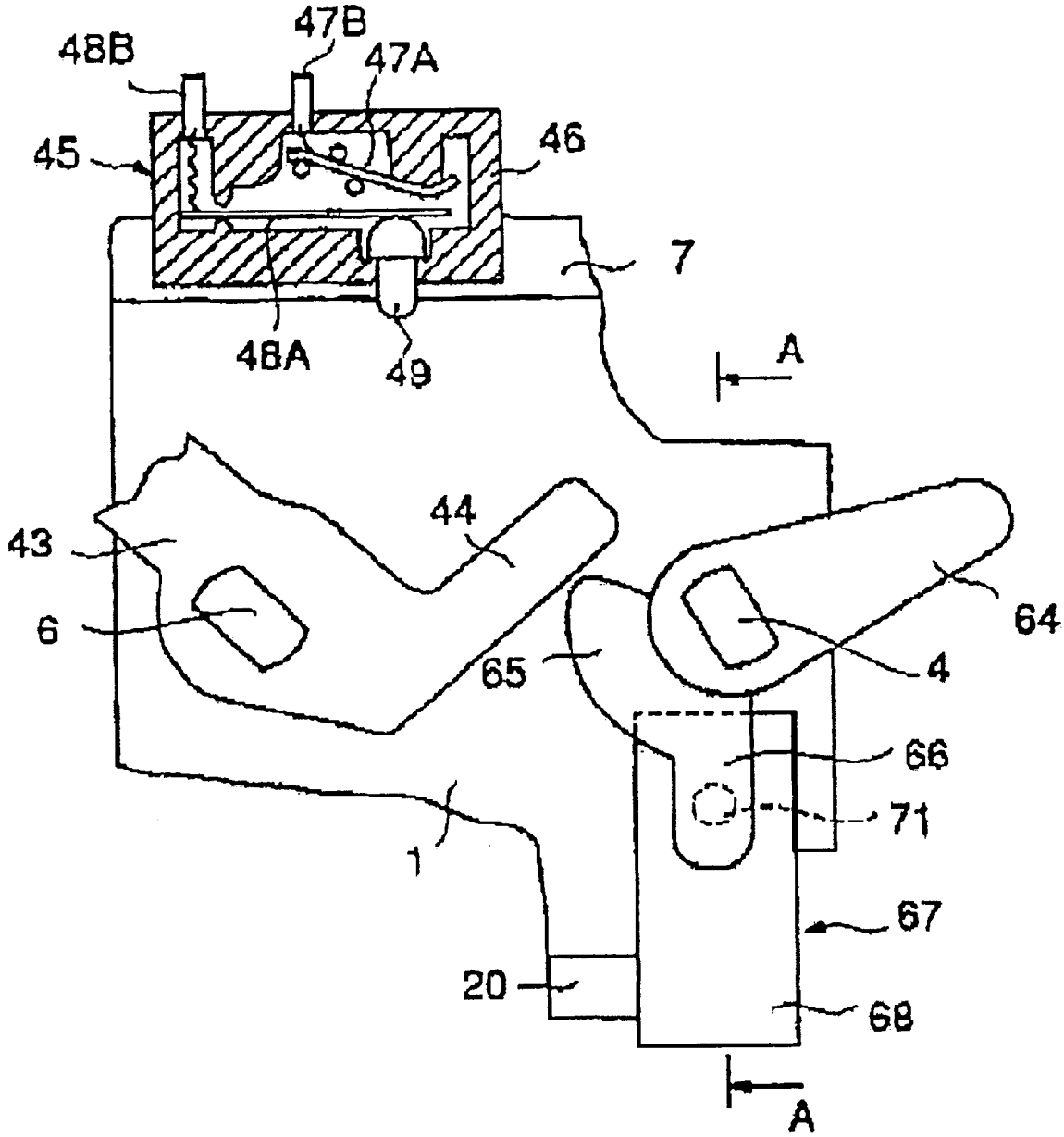
FIG. 4 is a partially truncated view of the lateral surface in the B—B direction of FIG. 1.
Figure 5:
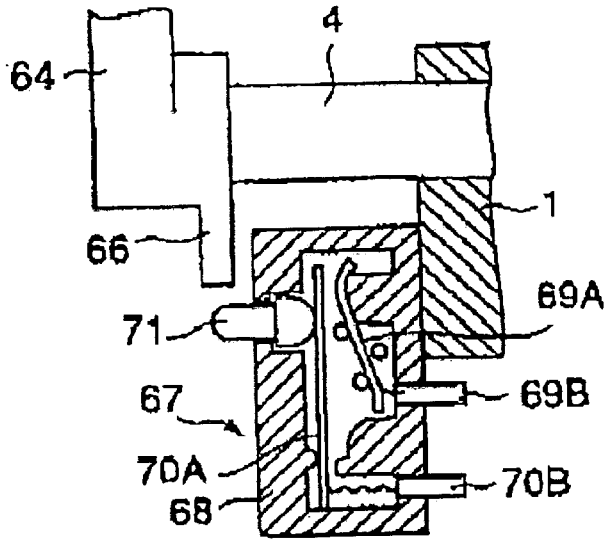
FIG. 5 is a cross section along the A—A line of FIG. 4.

Describing the preferred embodiments with reference to the diagrams, FIGS. 1 to 5 are diagrams showing a structure to which the present invention has been applied, wherein a main body 1 has an air intake passage 2 extending in the lateral direction, a choke valve 3 is positioned in the inlet portion of this air intake passage 2, and a throttle valve 5 is positioned in the portion proximate to the exit. These are butterfly valves that are mounted on the choke valve stem 4 and the throttle valve stem 6, which are rotatably supported by the main body 1.

A pump cover 7 is overlaid on one surface of the main body 1, with a pump diaphragm 9 sandwiched therebetween. Depressions that are formed opposite each other in the main body 1 and the pump cover 7 on both sides of the pump diaphragm 9 respectively form a pulse chamber 10 connected to the engine crank case and a pump chamber 11 for taking in and discharging fuel. The fuel in the fuel tank that passes through a conduit, is directed from the coupling tube 12 to the intake chamber 14 by way of the entrance valve 13. The fuel is suctioned into the pump chamber 11 by the movement of the pump diaphragm 9, which is caused to change its position in a reciprocating manner in accordance with the pressure pulse of the crankcase. The fuel is then directed to the discharge chamber 16 by way of the exit valve 15 under subsequent application of pressure. These components comprise a diaphragm-type fuel pump 8.

A constant fuel chamber 18, formed by a depression and separated from the atmosphere by a diaphragm 17, is disposed on the surface opposite from the pump cover 7, with the air intake passage 2 of the main body 1 disposed therebetween. The constant fuel chamber 18 holds a fixed quantity of fuel by cutting off or allowing fuel that flows through the fuel passageway 19 extending from the discharge chamber 16 to flow in through a fuel valve that opens and closes in accordance with the displacement of the diaphragm 17.

A first fuel system $F_1$ for delivering fuel from the constant fuel chamber 18 to the air intake passage 2 has a check valve 21 for preventing air from flowing into the constant fuel chamber 18 during priming, a fixed jet 22 that serves as the maximum flow regulating means A for fuel, a nozzle body 23, and a fuel port 27. The check valve 21 is disposed facing the constant fuel chamber 18. The fixed jet 22 and the nozzle body 23 are fitted adjacent each other so as to be air- and fluid-tight in a mounting hole 30, which is formed parallel to the throttle valve stem 6 in the portion between the constant fuel chamber 18 and the air intake passage 2 of the main body 1. The nozzle body 23 has a through-hole 24 that passes completely through the front and back and is connected to the jet hole exit of the fixed jet 22, and has one or a plurality of slit-shaped nozzle openings 25 in the peripheral side wall. The nozzle opening 25 is connected to the fuel port 27, which is the fuel outlet which opens on the downstream side of the throttle valve 5 of the air intake passage 2, by way of a toroidal chamber 26. Bleed air metered by a bleed air jet 28 is introduced between the toroidal chamber 26 and the fuel port 27.

The path that reaches the fuel port 27 byway of the jet hole of the fixed jet 22 from the above-described check valve 21, the through-hole 24 of the nozzle body 23, the nozzle opening 25, and the toroidal chamber 26 constitutes a first fuel passage 29. The fixed jet 22 is disposed in a location adjacent to the check valve 21.

A guide hole 31 is disposed on the same central axial line as the mounting hole 30 on the opposite side of the fixed jet 22 of the nozzle body 23. A holding member 33 in the form of a hollow shaft is fitted in the guide hole 31 while allowed to move in the axial direction wherein a metering needle 32 is held so as to protrude at the end. The metering needle 32 is inserted in the through-hole 24 of the nozzle body 23, with the base thereof threadably fitted into the holding member 33, so as to allow the protruding length from the end to be adjustable, and operates so as to change the aperture surface area of the nozzle opening 25.

The holding member 33 is fitted into the guide groove 35 formed by extending the diaphragm cover 20, and is attached to the guide member 34 which moves in a linear manner. The guide member 34 holds a contact piece 36 comprising a steel ball in a freely rotatable manner. Conversely, a cam 37 is fastened to one end portion of the throttle valve stem 6, and the contact piece 36 is kept in constant contact with this cam 37 by way of the spring force of a pushing spring 38.

In the idle position of the throttle valve 4, the contact piece 36 makes contact with the lowest portion of the cam 37 which makes the insertion of the metering needle 32 into the through-hole 24 deeper, and minimizes the aperture surface area of the nozzle opening 25. In the fully open position of the throttle valve 4, the contact piece 36 makes contact with the highest portion of the cam 37 which makes the insertion of the metering needle 32 into the through-hole 24 more shallow, and maximizes the aperture surface area of the nozzle opening 25. In other words, the metering needle 32 steplessly changes the aperture surface area of the nozzle opening 25 in accordance with the degree of opening of the throttle valve 5, delivers fuel to the engine at a flow rate corresponding to the inlet air quantity of the engine, and sets the basic flow rate of the negative pressure fuel that flows by negative pressure through the first fuel passage 29 and is delivered to the air intake passage 2 from the fuel port 27 in cooperation with the fixed jet 22.

The above-described nozzle body 23, metering needle 32, holding member 33, guide member 34, cam 37, and pushing spring 38 therefore constitute the mechanical fuel control means B for adjusting the negative pressure fuel flow rate delivered to the air intake passage 2 in accordance with the degree of opening of the throttle valve 5.

The valve element 41 of the control valve 40, with the fixed jet 22 serving as the valve seat, is subsequently inserted into the mounting hole 30 from the aperture end side. The control valve 40 is electromagnetically driven, and an actuator 42 thereof is configured such that the connector 42B fastened to and extending into the coil case 42A is attached to the main body 1 by being screwed into the mounting hole 30. The valve element 41 is disposed at the end of a movable iron core (plunger) 42C. The entrance of the jet hole of the fixed jet 22 is closed when the coil is nonconductive, and open when the coil is conductive. Fuel from the constant fuel chamber 18 is delivered to the nozzle body 23 by way of the check valve 21, the interior of the connector 42B, and the jet hole of the fixed jet 22.

The second fuel system $F_2$, which delivers fuel compressed by the fuel pump 8 to the air intake passage 2, branches from the fuel passageway 19 that extends toward the constant fuel chamber 18 from the discharge chamber 16. The second fuel system $F_2$ has a control valve 52 that transmits and cuts off positive pressure fuel, and a manual fuel flow rate adjusting means E.

The control valve 52 is electromagnetically driven, has a valve seat 53 pressed into the mounting hole 51 formed parallel to the throttle valve stem 6 in the portion between the fuel pump 8 and the air intake passage 2 of the main body 1, and also has a valve element 54 inserted into the mounting hole 51 from the aperture end side. An actuator 55 of this control valve 52 is configured such that the connector 55B fastened to and extending into the coil case 55A is attached to the main body 1 by being screwed into the mounting hole 51. The valve element 54 which is attached to the end of a movable iron core (plunger) 55C, is seated in the valve seat 53 when the coil is nonconductive to close the valve seat opening, and is separated from the valve seat 53 when the coil is conductive to open the valve seat opening.

A mounting hole 56 with internal threads is formed on the same central axial line as the mounting hole 51 on the exit side extension of the valve seat 53, with a metering jet 59 disposed therebetween. A screw 58 with a needle valve 57 disposed at the end thereof is screwed into the mounting hole 56. The needle valve 57 is inserted into the metering jet 59, and the effective surface area of the metering jet 59 can be changed by manually adjusting the screw depth of the screw 58. The needle valve 57 with this screw 58 and the metering jet 59 constitute the fuel flow rate adjusting means E. A seal member 60 made of elastic polymer material is mounted at the base of the needle valve 57. The seal member 60 serves to prevent leakage of positive pressure fuel and to prevent movement of the needle valve 57.

The path that branches off from the fuel passageway 19 and reaches the fuel port 61, which is the fuel outlet opened on the downstream side of the throttle valve 5 of the air intake passage 2, by way of the valve seat 53 and the metering jet 59 constitutes a second fuel passage 62. It is apparent from the above description that the two fuel systems $F_1$ and $F_2$ are entirely independent.

A throttle valve lever 43 is fastened to the end portion on the opposite side of the cam 37 of the throttle valve stem 6, and a second signal generator 45 is disposed in the pump cover 7. This second signal generator 45 comprises a fixed contact point 47A in the form of a flat spring, a movable contact point 48A mounted within a housing 46, and a push pin 49 held in a linearly movable fashion in the wall of the housing 46 so as to bend the moveable contact point 48A with the application of pressure and to cause contact with the fixed contact point 47A. The signal sent by the energizing from the contact of these contact points 47A and 48A is transmitted from the terminals 47B and 48B to the control circuit 74 (described hereinafter).

The push pin 49 is caused to move by an actuation arm 44 formed on the throttle valve lever 43, and in the present embodiment, the actuation arm 44 is configured so as to push the push pin 49 and send a signal in a range of degrees of opening of the throttle valve 5 from half open to slightly greater.

A choke lever 64 is fastened to the end portion of the choke valve stem 4 on the same side as the throttle valve lever 43, and a first signal generator 67 is mounted on the main body 1. The choke lever 64 has an advance cam 65 and an actuation arm 66. The first signal generator 67 is structured in the same manner as the second signal generator 45, and comprises a fixed contact point 69A in the form of a flat spring, a movable contact point 70A mounted within a housing 68, and a push pin 71 held in a linearly movable fashion in the wall of the housing 68 so as to bend the moveable contact point 70A with the application of pressure and to cause contact with the fixed contact point 69A. The signal sent by the energizing from the contact of these contact points 69A and 70A is transmitted from the terminals 69B and 70B to the control circuit 74 (described hereinafter).

The push pin 71 is caused to move by an actuation arm 66 formed on the choke valve lever 64. In the present embodiment, the actuation arm 66 is configured so as to push the push pin 71 and send a signal in a range of degrees of opening of the choke valve 3 from a fully closed to a slightly open position. The advance cam 65 at this time pushes the throttle valve lever 43 and opens throttle valve 5 to a start-up degree of opening, which is slightly greater than the idle degree of opening.

Figure 6:
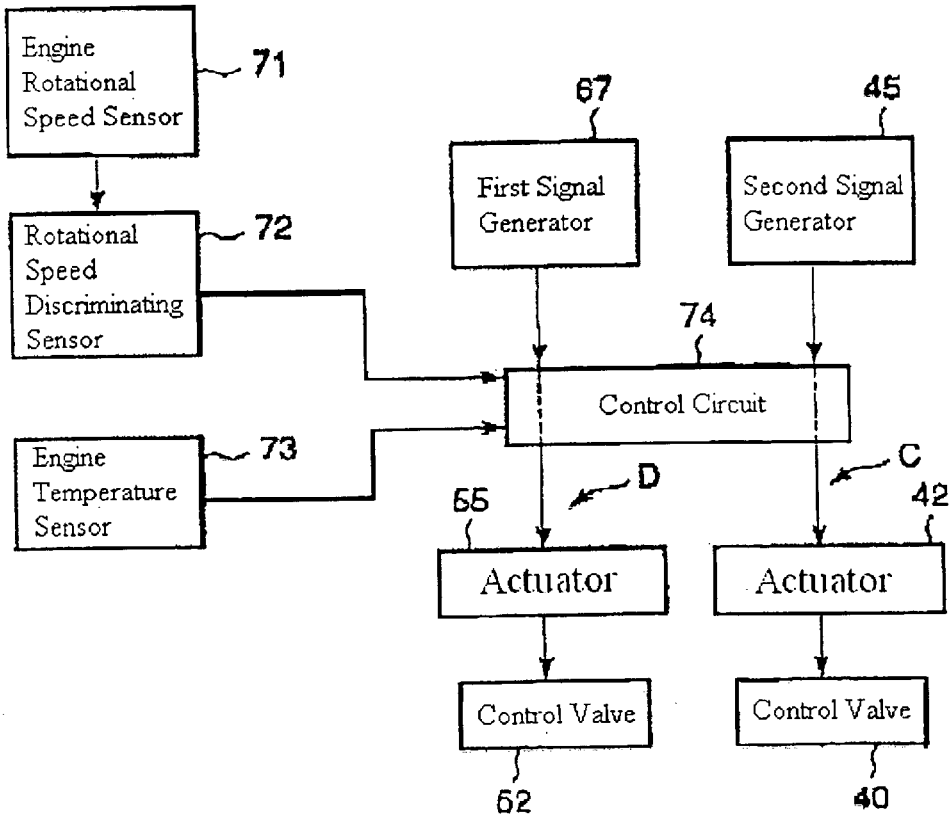
FIG. 6 is a layout diagram showing an embodiment of the electrical control circuit.

FIG. 6 is a layout diagram of the electrical control circuit, which comprises an engine rotational speed sensor 71, a rotational speed discriminating sensor 72, a second signal generator 45, a first signal generator 67, an engine temperature sensor 73, and a control circuit 74 for the actuators 42 and 55. Together with the control valve 40, these components constitute the electrical fuel control means C for the first fuel system $F_1$, which cuts off and delivers fuel from the constant fuel chamber 18 to the air intake passage 2. These components and the control valve 52 constitute the electrical fuel control means D for the second fuel system $F_2$, which cuts off and delivers fuel compressed by the fuel pump 8 to the air intake passage 2.

The rotational speed discriminating sensor 72 allows the rotational speed to be set in an arbitrary manner, and an input setting to be made by manual operation, making it possible to set a plurality of rotational speeds. In the present embodiment (referring to FIG. 7), the following parameters are set: the minimum rotational speed X for halting fuel delivery in order to eliminate an excessively rich mixture that results from the excessive delivery of fuel during cranking, the warm-up rotational speed Sw for warm-up operation, the lower limit rotational speed Sp required to maintain the warm-up rotational speed Sw, and an arbitrary target rotational speed Y. The target rotational speed Y is the rotational speed of an engine when machinery equipped with an engine performs work at rated operational speed. The actuation arm 44 is further formed so as to cause the second signal generator 45 to operate at a degree of opening position of the throttle valve 5 which provides an air intake quantity corresponding to this target rotational speed Y.

Figure 7:
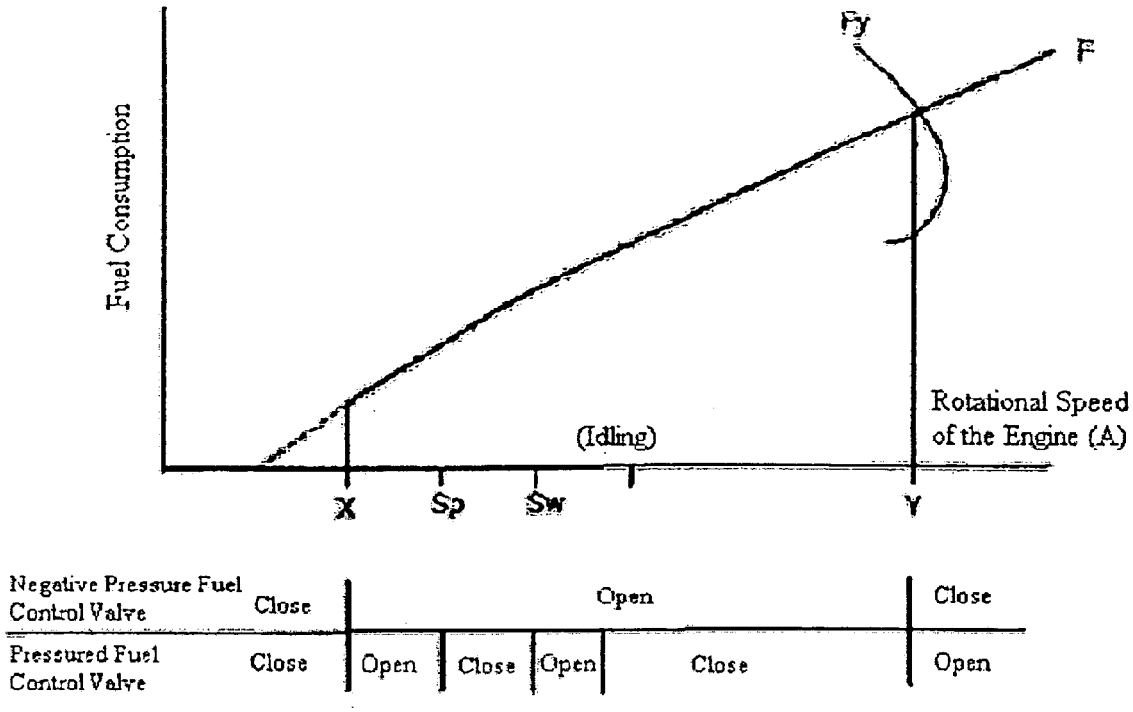
FIG. 7 is a graph describing the relationship between the rotational speed of the engine and fuel control.
Figure 8:
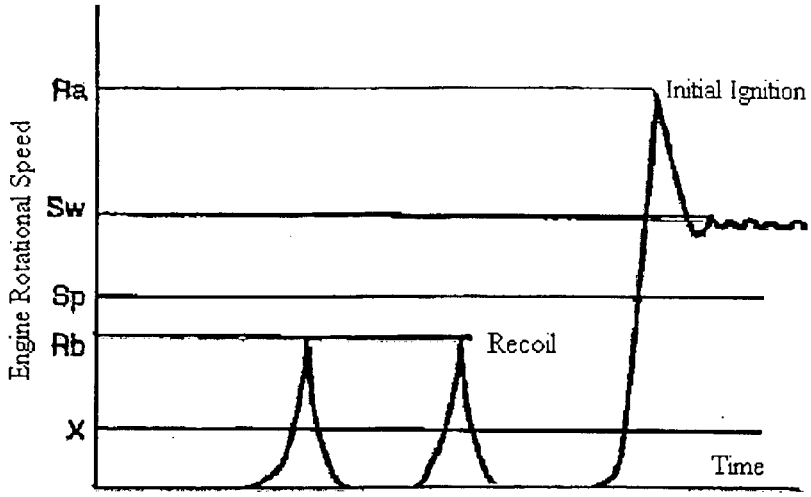
FIG. 8 is a graph describing the settings for the warm-up rotational speed.
Figure 9:
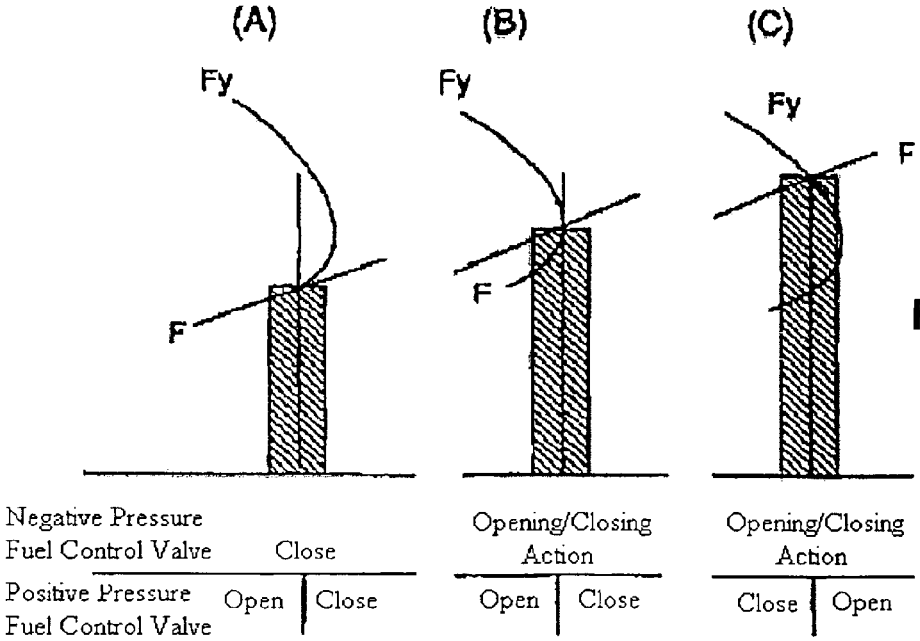
FIG. 9 is a graph describing the fuel control method at a target rotational speed.

Here, an example of controlling the fuel delivery from the two fuel systems $F_1$ and $F_2$ by the electrical fuel control means C and D is described based on FIGS. 7, 8, and 9. The curve F of fuel consumption versus the rotational speed of the engine in FIG. 7 shows the fuel consumption at a constant load.

When the ignition kill switch is switched ON to operate the engine, and when the engine begins rotating and the rotational speed A is determined to be $A<X$ by the rotational speed discriminating circuit 72 based on the signal from the engine rotational sensor 71, the control circuit 74 closes the two control valves 40 and 52, and fuel is not delivered from either of the fuel systems $F_1$ and $F_2$.

Here, when rotation is started with the choke valve 3 open, and when the engine temperature sensor 73 sends a high temperature signal to the control circuit 74 even if the choke valve 3 is closed and the first signal generator 67 transmits a start-up fuel supply signal to the control circuit 74, only the control valve 40 of the first fuel system $F_1$ is opened when $A>X$, and negative pressure fuel whose flow rate conforms to the curve F of fuel consumption is supplied to the engine.

When the engine temperature sensor 73 transmits a low temperature signal to the control circuit 74 when the choke valve 3 is closed and the engine is started, the two control valves 40 and 52 are both opened and the two fuel systems $F_1$ and $F_2$ deliver fuel when A>X based on the low temperature signal and the start-up fuel control command signal from the first signal generator 67, and a rich mixture required for engine start-up is supplied. The control valve 52 of the second fuel system $F_2$ is subsequently closed when A>Sp, and an excessively rich mixture is prevented from being formed.

When the relationship between the rotational speed of the engine A and the set warm-up rotational speed Sw is then A>Sw, the control valve 52 of the second fuel system $F_2$ is opened and the rotational speed of the engine A is reduced with the excessively rich mixture. By closing the control valve 52 when A<Sw and allowing only negative pressure fuel to be delivered from the first fuel system $F_1$, the rotational speed of the engine A is allowed to increase. The rotational speed of the engine A is maintained at the warm-up rotational speed Sw by repeating the above.

The lower limit rotational speed Sp is expediently set in order to set the warm-up rotational speed Sw, and has no other particular objective. The warm-up rotational speed Sw (referring to FIG. 8) is appropriately set within a range of rotational speeds that are lower than the initial ignition rotational speed Ra and higher than the recoil rotational speed Rb. Because the advance cam 65 of the choke lever 64 pushes the throttle valve lever 43 when the choke valve 3 is closed, and the throttle valve 5 is slightly opened from the degree of opening for idle, the present invention has advantages in that the difference between Ra and Rb is greater, it is easier to set the initial ignition rotational speed Sw, and the selection of setting values is further widened.

When warm-up is completed, the choke valve 3 is opened, and the first signal generator 67 no longer transmits to the control circuit 74 due to the actuation arm 66 coming free from the push pin 71, or when the engine temperature sensor 73 transmits a high temperature signal to the control circuit 74 indicating that warm-up is complete. When both states occur, the control circuit 74 controls the actuators 42 and 55 so that the control valve 40 of the first fuel system $F_1$ is held in an open state and the control valve 52 of the second fuel system $F_2$ is held in a closed state. By adopting the above approach, control of idling and the rotational speed of the engine wherein the throttle valve 5 is opened and closed is performed solely by the negative pressure fuel from the first fuel system $F_1$.

When the rotational speed of the engine A enters the region of the target rotational speed Y, the actuation arm 44 of the throttle valve 43 causes the second signal generator 45 to transmit a fuel control signal to the control circuit 74. When A>Y, the control valve 40 of the first fuel system $F_1$ is then closed and the control valve 52 of the second fuel control system $F_2$ is opened, a rich mixture is supplied by positive pressure fuel, and the rotational speed of the engine A is reduced. With this approach, when A<Y, the control valve 40 of the first fuel system $F_1$ is opened, the control valve 52 of the second fuel system $F_2$ is closed, an appropriate mixture is supplied by negative pressure fuel, and the rotational speed of the engine A is allowed to increase. The rotational speed of the engine A is maintained at the target rotational speed Y by repeating the above.

The flow rate required by the engine at the target rotational speed Y is shown by the curve Fy in FIG. 7. FIG. 9 is a graph describing an example of the control method whereby fuel at a flow rate on the curve Fy is supplied to the engine with a lean mixture. The target rotational speed Y can be maintained by these control methods as well without being limited to the above-described control method.

First, FIG. 9(A) shows that when the second signal generator 45 operates, the control valve 40 of the first fuel system $F_1$ is closed, and the control valve 52 of the second fuel system $F_2$ is opened. When the rotational speed of the engine A exceeds the target rotational speed Y, fuel delivery is halted by closing the control valve 52, whereby the control valve 52 of the second fuel system $F_2$ is opened and the rotational speed of the engine A is allowed to rise due to the positive pressure fuel when the rotational speed of the engine A decreases and A<Y. Adopting this approach allows the target rotational speed Y to be maintained with a mixture on the lean side.

FIG. 9(B) further shows that when the second signal generator 45 operates, the control valve 40 of the first fuel system $F_1$ switches from an open state to a repeating action of opening and closing in short cycles, and the control valve 52 of the second fuel system $F_2$ is opened. When the rotational speed of the engine A exceeds the target rotational speed Y due to the fuel from these valves, the control valve 52 is closed to create a fuel deficiency, and the rotational speed of the engine A is reduced. When A<Y the control valve 52 is opened, positive pressure fuel is added from the second fuel system $F_2$, and the rotational speed of the engine A is allowed to rise. Adopting this approach also allows the target rotational speed Y to be maintained with a mixture on the lean side. Even if the control valve 52 does not open due to a malfunction of the electrical system, this approach also allows operation to continue without concern of seizure or other problems because negative pressure fuel is substantially continuously supplied from the first fuel system $F_1$.

FIG. 9(C) yet further shows that when the second signal generator 45 operates, the control valve 40 of the first fuel system $F_1$ switches from an open state to a repeating action of closing the valve for a short period and opening the valve for a longer period. When the rotational speed of the engine A exceeds the target rotational speed Y, the control valve 52 of the second fuel system $F_2$ is opened, and the mixture is temporarily made rich by adding positive pressure fuel, decreasing the rotational speed of the engine A. When A<Y the control valve 52 is closed and the rotational speed of the engine A is allowed to rise. Adopting this approach allows the target rotational speed Y to be maintained.

Thus, the rotational speed of the engine at engine start-up or additionally in a specific region of engine rotations is compared with a set value, and by controlling the fuel delivery quantity from the two fuel systems so that a required rotational speed is maintained, stable operation can be achieved by responding to fluctuations in the load at a set target rotational speed without allowing large or unpredictable fluctuations in the rotational speed to occur. Because positive pressure fuel can deliver a predetermined flow rate in the very short time that the control valve 52 is open in comparison with negative pressure fuel, this type of fuel is advantageous for controlling rotational speed.

The fuel control described in FIGS. 7, 8 and 9 uses the command signals of the first signal generator 67 and the second signal generator 45 in an interrelated manner to open and close the control valve 40 of the first fuel system $F_1$ and to open and close the control valve 52 of the second fuel system $F_2$. However, the command signal of the first signal generator 67 may be used solely to perform fuel delivery from the second fuel system $F_2$ at start-up, and the command signal of the second signal generator 45 may also be used solely to perform fuel delivery control from the second fuel system $F_2$ in cooperation with the command signal from the rotational speed discriminating circuit 72 in a specific range of degrees of opening of the throttle valve. Furthermore, because the first signal generator 67 causes start-up fuel to be delivered from the second fuel system $F_2$ when the choke valve 3 is closed, the object of the present invention can be achieved without using the engine temperature sensor 73.

The first fuel system $F_1$ can further be configured so as to constantly deliver negative pressure fuel that is adjusted by the metering needle 32 linked to the throttle valve 5, and fuel flow rate adjustment for controlling the rotational speed can be performed solely with the control valve 52 of the second fuel system $F_2$; and, in this case, the control valve 40 is not required.

Alternatively, a stopper for controlling the stroke of the valve element 41 of the control valve 40 of the first fuel system $F_1$ can be provided, leaving the first fuel passage 29 slightly open when the actuator 42 is demagnetized; and this approach has the advantage of lightening the burden on the two control valves 40 and 52.

According to the present invention as described above, fuel can be supplied in an appropriate amount and start-up and warm-up can be stably performed, and operation whereby a stable target rotational speed is maintained in a required rotational range can additionally be performed.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

What is claimed is:

1. A carburetor comprising:

a first fuel system having maximum flow regulating means for fuel and mechanical fuel control means for adjusting the fuel flow in accordance with the degree of opening of a throttle valve, and for delivering fuel from a constant fuel chamber to an air intake passage; and a second fuel system having electrical fuel control means for adjusting the fuel flow rate so as to achieve a required target rotational speed of the engine in a start-up range of the degrees of opening of the throttle valve, and for delivering fuel compressed by a fuel pump to the air intake passage.

2. The carburetor of claim 1, wherein the electrical fuel control means of the second fuel system, in addition to adjusting the fuel flow rate in a start-up range of the degrees of opening of the throttle valve, adjusts the fuel flow rate so as to achieve a required target rotational speed of the engine in at least one other specific range of degrees of opening of the throttle valve.

3. The carburetor of claim 1, wherein the first fuel system, in addition to the maximum flow regulating means and mechanical fuel control means, has electrical fuel control means for adjusting the fuel flow rate so as to achieve a required target rotational speed of the engine in a specific range of degrees of opening of the throttle valve.

4. The carburetor of claim 2, wherein the first fuel system, in addition to the maximum flow regulating means and mechanical fuel control means, has electrical fuel control means for adjusting the fuel flow rate so as to achieve a required target rotational speed of the engine in a specific range of degrees of opening of the throttle valve.

5. The carburetor of claim 1, wherein the second fuel system has a manual fuel flow rate adjusting means, in addition to the electrical fuel control means.

6. The carburetor of claim 2, wherein the second fuel system has a manual fuel flow rate adjusting means, in addition to the electrical fuel control means.

7. The carburetor of claim 3, wherein the second fuel system has a manual fuel flow rate adjusting means, in addition to the electrical fuel control means.

8. The carburetor of claim 4, wherein the second fuel system has a manual fuel flow rate adjusting means, in addition to the electrical fuel control means.

9. The carburetor of claim 1, wherein the first fuel system and the second fuel system are mutually independent, and the fuel outlets thereof are opened on the downstream side of the throttle valve of the air intake passage.

10. The carburetor of claim 2, wherein the first fuel system and the second fuel system are mutually independent, and the fuel outlets thereof are opened on the downstream side of the throttle valve of the air intake passage.

11. The carburetor of claim 3, wherein the first fuel system and the second fuel system are mutually independent, and the fuel outlets thereof are opened on the downstream side of the throttle valve of the air intake passage.

12. The carburetor of claim 4, wherein the first fuel system and the second fuel system are mutually independent, and the fuel outlets thereof are opened on the downstream side of the throttle valve of the air intake passage.

13. The carburetor of claim 5, wherein the first fuel system and the second fuel system are mutually independent, and the fuel outlets thereof are opened on the downstream side of the throttle valve of the air intake passage.

14. The carburetor of claim 6, wherein the first fuel system and the second fuel system are mutually independent, and the fuel outlets thereof are opened on the downstream side of the throttle valve of the air intake passage.

15. The carburetor of claim 7, wherein the first fuel system and the second fuel system are mutually independent, and the fuel outlets thereof are opened on the downstream side of the throttle valve of the air intake passage.

16. The carburetor of claim 8, wherein the first fuel system and the second fuel system are mutually independent, and the fuel outlets thereof are opened on the downstream side of the throttle valve of the air intake passage.

17. The carburetor of claim 1, wherein the electrical fuel control means of the second fuel system comprises:

an engine rotational speed sensor;

a rotational speed discriminating circuit that is capable of inputting and setting an arbitrary rotational speed, and that compares the set rotational speed and the rotational speed of the engine detected by the engine rotational speed sensor and issues command signals;

a first signal generator for issuing command signals when the choke valve is in the closed-valve position;

an electromagnetically driven control valve for cutting off and delivering fuel to the air intake passage; and a control circuit for magnetizing and demagnetizing an actuator for the opening/closing valve based on the command signals.

18. The carburetor of claim 2, wherein the electrical fuel control means of the second fuel system comprises:

an engine rotational speed sensor;

a rotational speed discriminating circuit that is capable of inputting and setting an arbitrary rotational speed, and that compares the set rotational speed and the rotational speed of the engine detected by the engine rotational speed sensor and issues command signals;

a first signal generator for issuing command signals when the choke valve is in the closed-valve position;

an electromagnetically driven control valve for cutting off and delivering fuel to the air intake passage; and a control circuit for magnetizing and demagnetizing an actuator for the opening/closing valve based on the command signals.

19. The carburetor of claim 3, wherein the electrical fuel control means of the second fuel system comprises:

an engine rotational speed sensor;

a rotational speed discriminating circuit that is capable of inputting and setting an arbitrary rotational speed, and that compares the set rotational speed and the rotational speed of the engine detected by the engine rotational speed sensor and issues command signals;

a first signal generator for issuing command signals when a choke valve is in the closed-valve position;

an electromagnetically driven control valve for cutting off and delivering fuel to the air intake passage; and a control circuit for magnetizing and demagnetizing an actuator for the opening/closing valve based on the command signals.

20. The carburetor of claim 4, wherein the electrical fuel control means of the second fuel system comprises:

an engine rotational speed sensor;

a rotational speed discriminating circuit that is capable of inputting and setting an arbitrary rotational speed, and that compares the set rotational speed and the rotational speed of the engine detected by the engine rotational speed sensor and issues command signals;

a first signal generator for issuing command signals when a choke valve is in the closed-valve position;

an electromagnetically driven control valve for cutting off and delivering fuel to the air intake passage; and a control circuit for magnetizing and demagnetizing an actuator for the opening/closing valve based on the command signals.

21. The carburetor of claim 5, wherein the electrical fuel control means of the second fuel system comprises:

an engine rotational speed sensor;

a rotational speed discriminating circuit that is capable of inputting and setting an arbitrary rotational speed, and that compares the set rotational speed and the rotational speed of the engine detected by the engine rotational speed sensor and issues command signals;

a first signal generator for issuing command signals when a choke valve is in the closed-valve position;

an electromagnetically driven control valve for cutting off and delivering fuel to the air intake passage; and a control circuit for magnetizing and demagnetizing an actuator for the opening/closing valve based on the command signals.

22. The carburetor of claim 6, wherein the electrical fuel control means of the second fuel system comprises:

an engine rotational speed sensor;

a rotational speed discriminating circuit that is capable of inputting and setting an arbitrary rotational speed, and that compares the set rotational speed and the rotational speed of the engine detected by the engine rotational speed sensor and issues command signals;

a first signal generator for issuing command signals when a choke valve is in the closed-valve position;

an electromagnetically driven control valve for cutting off and delivering fuel to the air intake passage; and a control circuit for magnetizing and demagnetizing an actuator for the opening/closing valve based on the command signals.

23. The carburetor of claim 7, wherein the electrical fuel control means of the second fuel system comprises:

an engine rotational speed sensor;

a rotational speed discriminating circuit that is capable of inputting and setting an arbitrary rotational speed, and that compares the set rotational speed and the rotational speed of the engine detected by the engine rotational speed sensor and issues command signals;

a first signal generator for issuing command signals when a choke valve is in the closed-valve position;

an electromagnetically driven control valve for cutting off and delivering fuel to the air intake passage; and a control circuit for magnetizing and demagnetizing an actuator for the opening/closing valve based on the command signals.

24. The carburetor of claim 8, wherein the electrical fuel control means of the second fuel system comprises:

an engine rotational speed sensor;

a rotational speed discriminating circuit that is capable of inputting and setting an arbitrary rotational speed, and that compares the set rotational speed and the rotational speed of the engine detected by the engine rotational speed sensor and issues command signals;

a first signal generator for issuing command signals when a choke valve is in the closed-valve position;

an electromagnetically driven control valve for cutting off and delivering fuel to the air intake passage; and a control circuit for magnetizing and demagnetizing an actuator for the opening/closing valve based on the command signals.

25. The carburetor of claim 17, wherein the electrical fuel control means of the second fuel system further comprises a second signal generator for transmitting command signals to the control circuit in a specific range of degrees of opening of the throttle valve, and wherein the control circuit magnetizes and demagnetizes the actuator on the basis of the command signals from the rotational speed discriminating circuit, the first signal generator, and the second signal generator.

26. The carburetor of claim 18, wherein the electrical fuel control means of the second fuel system further comprises a second signal generator for transmitting command signals to the control circuit in a specific range of degrees of opening of the throttle valve, and wherein the control circuit magnetizes and demagnetizes the actuator on the basis of the command signals from the rotational speed discriminating circuit, the first signal generator, and the second signal generator.

27. The carburetor of claim 19, wherein the electrical fuel control means of the second fuel system further comprises a second signal generator for transmitting command signals to the control circuit in a specific range of degrees of opening of the throttle valve, and wherein the control circuit magnetizes and demagnetizes the actuator on the basis of the command signals from the rotational speed discriminating circuit, the first signal generator, and the second signal generator.

28. The carburetor of claim 20, wherein the electrical fuel control means of the second fuel system further comprises a second signal generator for transmitting command signals to the control circuit in a specific range of degrees of opening of the throttle valve, and wherein the control circuit magnetizes and demagnetizes the actuator on the basis of the command signals from the rotational speed discriminating circuit, the first signal generator, and the second signal generator.

29. The carburetor of claim 21, wherein the electrical fuel control means of the second fuel system further comprises a second signal generator for transmitting command signals to the control circuit in a specific range of degrees of opening of the throttle valve, and wherein the control circuit magnetizes and demagnetizes the actuator on the basis of the command signals from the rotational speed discriminating circuit, the first signal generator, and the second signal generator.

30. The carburetor of claim 22, wherein the electrical fuel control means of the second fuel system further comprises a second signal generator for transmitting command signals to the control circuit in a specific range of degrees of opening of the throttle valve, and wherein the control circuit magnetizes and demagnetizes the actuator on the basis of the command signals from the rotational speed discriminating circuit, the first signal generator, and the second signal generator.

31. The carburetor of claim 23, wherein the electrical fuel control means of the second fuel system further comprises a second signal generator for transmitting command signals to the control circuit in a specific range of degrees of opening of the throttle valve, and wherein the control circuit magnetizes and demagnetizes the actuator on the basis of the command signals from the rotational speed discriminating circuit, the first signal generator, and the second signal generator.

32. The carburetor of claim 24, wherein the electrical fuel control means of the second fuel system further comprises a second signal generator for transmitting command signals to the control circuit in a specific range of degrees of opening of the throttle valve, and wherein the control circuit magnetizes and demagnetizes the actuator on the basis of the command signals from the rotational speed discriminating circuit, the first signal generator, and the second signal generator.

33. The carburetor of claim 17, wherein the electrical fuel control means of the second fuel system further comprises an engine temperature sensor for detecting the engine temperature and transmitting temperature signals to the control circuit, and wherein the control circuit magnetizes and demagnetizes the actuator on the basis of the command signals and temperature signals.

34. The carburetor of claim 18, wherein the electrical fuel control means of the second fuel system further comprises an engine temperature sensor for detecting the engine temperature and transmitting temperature signals to the control circuit, and wherein the control circuit magnetizes and demagnetizes the actuator on the basis of the command signals and temperature signals.

35. The carburetor of claim 19, wherein the electrical fuel control means of the second fuel system further comprises an engine temperature sensor for detecting the engine temperature and transmitting temperature signals to the control circuit, and wherein the control circuit magnetizes and demagnetizes the actuator on the basis of the command signals and temperature signals.

36. The carburetor of claim 20, wherein the electrical fuel control means of the second fuel system further comprises an engine temperature sensor for detecting the engine temperature and transmitting temperature signals to the control circuit, and wherein the control circuit magnetizes and demagnetizes the actuator on the basis of the command signals and temperature signals.

37. The carburetor of claim 21, wherein the electrical fuel control means of the second fuel system further comprises an engine temperature sensor for detecting the engine temperature and transmitting temperature signals to the control circuit, and wherein the control circuit magnetizes and demagnetizes the actuator on the basis of the command signals and temperature signals.

38. The carburetor of claim 22, wherein the electrical fuel control means of the second fuel system further comprises an engine temperature sensor for detecting the engine temperature and transmitting temperature signals to the control circuit, and wherein the control circuit magnetizes and demagnetizes the actuator on the basis of the command signals and temperature signals.

39. The carburetor of claim 23, wherein the electrical fuel control means of the second fuel system further comprises an engine temperature sensor for detecting the engine temperature and transmitting temperature signals to the control circuit, and wherein the control circuit magnetizes and demagnetizes the actuator on the basis of the command signals and temperature signals.

40. The carburetor of claim 24, wherein the electrical fuel control means of the second fuel system further comprises an engine temperature sensor for detecting the engine temperature and transmitting temperature signals to the control circuit, and wherein the control circuit magnetizes and demagnetizes the actuator on the basis of the command signals and temperature signals.

41. The carburetor of claim 25, wherein the electrical fuel control means of the second fuel system further comprises an engine temperature sensor for detecting the engine temperature and transmitting temperature signals to the control circuit, and wherein the control circuit magnetizes and demagnetizes the actuator on the basis of the command signals and temperature signals.

42. The carburetor of claim 26, wherein the electrical fuel control means of the second fuel system further comprises an engine temperature sensor for detecting the engine temperature and transmitting temperature signals to the control circuit, and wherein the control circuit magnetizes and demagnetizes the actuator on the basis of the command signals and temperature signals.

43. The carburetor of claim 27, wherein the electrical fuel control means of the second fuel system further comprises an engine temperature sensor for detecting the engine temperature and transmitting temperature signals to the control circuit, and wherein the control circuit magnetizes and demagnetizes the actuator on the basis of the command signals and temperature signals.

44. The carburetor of claim 28, wherein the electrical fuel control means of the second fuel system further comprises an engine temperature sensor for detecting the engine temperature and transmitting temperature signals to the control circuit, and wherein the control circuit magnetizes and demagnetizes the actuator on the basis of the command signals and temperature signals.

45. The carburetor of claim 29, wherein the electrical fuel control means of the second fuel system further comprises an engine temperature sensor for detecting the engine temperature and transmitting temperature signals to the control circuit, and wherein the control circuit magnetizes and demagnetizes the actuator on the basis of the command signals and temperature signals.

46. The carburetor of claim 30, wherein the electrical fuel control means of the second fuel system further comprises an engine temperature sensor for detecting the engine temperature and transmitting temperature signals to the control circuit, and wherein the control circuit magnetizes and demagnetizes the actuator on the basis of the command signals and temperature signals.

47. The carburetor of claim 31, wherein the electrical fuel control means of the second fuel system further comprises an engine temperature sensor for detecting the engine temperature and transmitting temperature signals to the control circuit, and wherein the control circuit magnetizes and demagnetizes the actuator on the basis of the command signals and temperature signals.

48. The carburetor of claim 32, wherein the electrical fuel control means of the second fuel system further comprises an engine temperature sensor for detecting the engine temperature and transmitting temperature signals to the control circuit, and wherein the control circuit magnetizes and demagnetizes the actuator on the basis of the command signals and temperature signals.

49. The carburetor of claim 3, wherein the electrical fuel control means of the first control system comprises:

an engine rotational speed sensor;

a rotational speed discriminating circuit that is capable of inputting and setting an arbitrary rotational speed, and that compares the set rotational speed and the rotational speed of the engine detected by the engine rotational speed sensor and issues command signals;

a second signal generator for issuing command signals in a specific range of degrees of opening of the throttle valve;

an electromagnetically driven control valve for cutting off and delivering fuel to the air intake passage; and a control circuit for magnetizing and demagnetizing an actuator for the control valve based on the commands.

50. The carburetor of claim 4, wherein the electrical fuel control means of the first control system comprises:

an engine rotational speed sensor;

a rotational speed discriminating circuit that is capable of inputting and setting an arbitrary rotational speed, and that compares the set rotational speed and the rotational speed of the engine detected by the engine rotational speed sensor and issues command signals;

a second signal generator for issuing command signals in a specific range of degrees of opening of the throttle valve;

an electromagnetically driven control valve for cutting off and delivering fuel to the air intake passage; and a control circuit for magnetizing and demagnetizing an actuator for the control valve based on the commands.

51. The carburetor of claim 5, wherein the electrical fuel control means of the first control system comprises:

an engine rotational speed sensor;

a rotational speed discriminating circuit that is capable of inputting and setting an arbitrary rotational speed, and that compares the set rotational speed and the rotational speed of the engine detected by the engine rotational speed sensor and issues command signals;

a second signal generator for issuing command signals in a specific range of degrees of opening of the throttle valve;

an electromagnetically driven control valve for cutting off and delivering fuel to the air intake passage; and a control circuit for magnetizing and demagnetizing an actuator for the control valve based on the commands.

52. The carburetor of claim 6, wherein the electrical fuel control means of the first control system comprises:

an engine rotational speed sensor;

a rotational speed discriminating circuit that is capable of inputting and setting an arbitrary rotational speed, and that compares the set rotational speed and the rotational speed of the engine detected by the engine rotational speed sensor and issues command signals;

a second signal generator for issuing command signals in a specific range of degrees of opening of the throttle valve;

an electromagnetically driven control valve for cutting off and delivering fuel to the air intake passage; and a control circuit for magnetizing and demagnetizing an actuator for the control valve based on the commands.

53. The carburetor of claim 7, wherein the electrical fuel control means of the first control system comprises:

an engine rotational speed sensor;

a rotational speed discriminating circuit that is capable of inputting and setting an arbitrary rotational speed, and that compares the set rotational speed and the rotational speed of the engine detected by the engine rotational speed sensor and issues command signals;

a second signal generator for issuing command signals in a specific range of degrees of opening of the throttle valve;

an electromagnetically driven control valve for cutting off and delivering fuel to the air intake passage; and a control circuit for magnetizing and demagnetizing an actuator for the control valve based on the commands.

54. The carburetor of claim 8, wherein the electrical fuel control means of the first control system comprises:

an engine rotational speed sensor;

a rotational speed discriminating circuit that is capable of inputting and setting an arbitrary rotational speed, and that compares the set rotational speed and the rotational speed of the engine detected by the engine rotational speed sensor and issues command signals;

a second signal generator for issuing command signals in a specific range of degrees of opening of the throttle valve;

an electromagnetically driven control valve for cutting off and delivering fuel to the air intake passage; and a control circuit for magnetizing and demagnetizing an actuator for the control valve based on the commands.

55. The carburetor of claim 49, wherein the electrical fuel control means of the first control system further comprises a first signal generator for transmitting command signals to the control circuit when the choke valve is in the closed position, and wherein the control circuit magnetizes and demagnetizes the actuator on the basis of the command signals from the rotational speed discriminating circuit, the first signal generator, and the second signal generator.

56. The carburetor of claim 50, wherein the electrical fuel control means of the first control system further comprises a first signal generator for transmitting command signals to the control circuit when the choke valve is in the closed position, and wherein the control circuit magnetizes and demagnetizes the actuator on the basis of the command signals from the rotational speed discriminating circuit, the first signal generator, and the second signal generator.

57. The carburetor of claim 51, wherein the electrical fuel control means of the first control system further comprises a first signal generator for transmitting command signals to the control circuit when the choke valve is in the closed position, and wherein the control circuit magnetizes and demagnetizes the actuator on the basis of the command signals from the rotational speed discriminating circuit, the first signal generator, and the second signal generator.

58. The carburetor of claim 52, wherein the electrical fuel control means of the first control system further comprises a first signal generator for transmitting command signals to the control circuit when the choke valve is in the closed position, and wherein the control circuit magnetizes and demagnetizes the actuator on the basis of the command signals from the rotational speed discriminating circuit, the first signal generator, and the second signal generator.

59. The carburetor of claim 53, wherein the electrical fuel control means of the first control system further comprises a first signal generator for transmitting command signals to the control circuit when the choke valve is in the closed position, and wherein the control circuit magnetizes and demagnetizes the actuator on the basis of the command signals from the rotational speed discriminating circuit, the first signal generator, and the second signal generator.

60. The carburetor of claim 54, wherein the electrical fuel control means of the first control system further comprises a first signal generator for transmitting command signals to the control circuit when the choke valve is in the closed position, and wherein the control circuit magnetizes and demagnetizes the actuator on the basis of the command signals from the rotational speed discriminating circuit, the first signal generator, and the second signal generator.

61. The carburetor of claim 49, wherein the electrical fuel control means of the first control system further comprises an engine temperature sensor for detecting the engine temperature and transmitting temperature signals to the control circuit, and wherein the control circuit magnetizes and demagnetizes the actuator on the basis of the command signals and temperature signals.

62. The carburetor of claim 50, wherein the electrical fuel control means of the first control system further comprises an engine temperature sensor for detecting the engine temperature and transmitting temperature signals to the control circuit, and wherein the control circuit magnetizes and demagnetizes the actuator on the basis of the command signals and temperature signals.

63. The carburetor of claim 51, wherein the electrical fuel control means of the first control system further comprises an engine temperature sensor for detecting the engine temperature and transmitting temperature signals to the control circuit, and wherein the control circuit magnetizes and demagnetizes the actuator on the basis of the command signals and temperature signals.

64. The carburetor of claim 52, wherein the electrical fuel control means of the first control system further comprises an engine temperature sensor for detecting the engine temperature and transmitting temperature signals to the control circuit, and wherein the control circuit magnetizes and demagnetizes the actuator on the basis of the command signals and temperature signals.

65. The carburetor of claim 53, wherein the electrical fuel control means of the first control system further comprises an engine temperature sensor for detecting the engine temperature and transmitting temperature signals to the control circuit, and wherein the control circuit magnetizes and demagnetizes the actuator on the basis of the command signals and temperature signals.

66. The carburetor of claim 54, wherein the electrical fuel control means of the first control system further comprises an engine temperature sensor for detecting the engine temperature and transmitting temperature signals to the control circuit, and wherein the control circuit magnetizes and demagnetizes the actuator on the basis of the command signals and temperature signals.

67. The carburetor of claim 55, wherein the electrical fuel control means of the first control system further comprises an engine temperature sensor for detecting the engine temperature and transmitting temperature signals to the control circuit, and wherein the control circuit magnetizes and demagnetizes the actuator on the basis of the command signals and temperature signals.

68. The carburetor of claim 56, wherein the electrical fuel control means of the first control system further comprises an engine temperature sensor for detecting the engine temperature and transmitting temperature signals to the control circuit, and wherein the control circuit magnetizes and demagnetizes the actuator on the basis of the command signals and temperature signals.

69. The carburetor of claim 57, wherein the electrical fuel control means of the first control system further comprises an engine temperature sensor for detecting the engine temperature and transmitting temperature signals to the control circuit, and wherein the control circuit magnetizes and demagnetizes the actuator on the basis of the command signals and temperature signals.

70. The carburetor of claim 58, wherein the electrical fuel control means of the first control system further comprises an engine temperature sensor for detecting the engine temperature and transmitting temperature signals to the control circuit, and wherein the control circuit magnetizes and demagnetizes the actuator on the basis of the command signals and temperature signals.

71. The carburetor of claim 59, wherein the electrical fuel control means of the first control system further comprises an engine temperature sensor for detecting the engine temperature and transmitting temperature signals to the control circuit, and wherein the control circuit magnetizes and demagnetizes the actuator on the basis of the command signals and temperature signals.

72. The carburetor of claim 60, wherein the electrical fuel control means of the first control system further comprises an engine temperature sensor for detecting the engine temperature and transmitting temperature signals to the control circuit, and wherein the control circuit magnetizes and demagnetizes the actuator on the basis of the command signals and temperature signals.

73. The carburetor of claim 49, wherein the control valve of the first fuel system opens a first fuel passage when the actuator is magnetized, and a slightly open state is maintained when there is no magnetization.

74. The carburetor of claim 50, wherein the control valve of the first fuel system opens a first fuel passage when the actuator is magnetized, and a slightly open state is maintained when there is no magnetization.

75. The carburetor of claim 51, wherein the control valve of the first fuel system opens a first fuel passage when the actuator is magnetized, and a slightly open state is maintained when there is no magnetization.

76. The carburetor of claim 52, wherein the control valve of the first fuel system opens a first fuel passage when the actuator is magnetized, and a slightly open state is maintained when there is no magnetization.

77. The carburetor of claim 53, wherein the control valve of the first fuel system opens a first fuel passage when the actuator is magnetized, and a slightly open state is maintained when there is no magnetization.

78. The carburetor of claim 54, wherein the control valve of the first fuel system opens a first fuel passage when the actuator is magnetized, and a slightly open state is maintained when there is no magnetization.

79. The carburetor of claim 55, wherein the control valve of the first fuel system opens a first fuel passage when the actuator is magnetized, and a slightly open state is maintained when there is no magnetization.

80. The carburetor of claim 56, wherein the control valve of the first fuel system opens a first fuel passage when the actuator is magnetized, and a slightly open state is maintained when there is no magnetization.

81. The carburetor of claim 57, wherein the control valve of the first fuel system opens a first fuel passage when the actuator is magnetized, and a slightly open state is maintained when there is no magnetization.

82. The carburetor of claim 58, wherein the control valve of the first fuel system opens a first fuel passage when the actuator is magnetized, and a slightly open state is maintained when there is no magnetization.

83. The carburetor of claim 59, wherein the control valve of the first fuel system opens a first fuel passage when the actuator is magnetized, and a slightly open state is maintained when there is no magnetization.

84. The carburetor of claim 60, wherein the control valve of the first fuel system opens a first fuel passage when the actuator is magnetized, and a slightly open state is maintained when there is no magnetization.

85. The carburetor of claim 61, wherein the control valve of the first fuel system opens a first fuel passage when the actuator is magnetized, and a slightly open state is maintained when there is no magnetization.

86. The carburetor of claim 62, wherein the control valve of the first fuel system opens a first fuel passage when the actuator is magnetized, and a slightly open state is maintained when there is no magnetization.

87. The carburetor of claim 63, wherein the control valve of the first fuel system opens a first fuel passage when the actuator is magnetized, and a slightly open state is maintained when there is no magnetization.

88. The carburetor of claim 64, wherein the control valve of the first fuel system opens a first fuel passage when the actuator is magnetized, and a slightly open state is maintained when there is no magnetization.

89. The carburetor of claim 65, wherein the control valve of the first fuel system opens a first fuel passage when the actuator is magnetized, and a slightly open state is maintained when there is no magnetization.

90. The carburetor of claim 66, wherein the control valve of the first fuel system opens a first fuel passage when the actuator is magnetized, and a slightly open state is maintained when there is no magnetization.

91. The carburetor of claim 67, wherein the control valve of the first fuel system opens a first fuel passage when the actuator is magnetized, and a slightly open state is maintained when there is no magnetization.

92. The carburetor of claim 68, wherein the control valve of the first fuel system opens a first fuel passage when the actuator is magnetized, and a slightly open state is maintained when there is no magnetization.

93. The carburetor of claim 69, wherein the control valve of the first fuel system opens a first fuel passage when the actuator is magnetized, and a slightly open state is maintained when there is no magnetization.

94. The carburetor of claim 70, wherein the control valve of the first fuel system opens a first fuel passage when the actuator is magnetized, and a slightly open state is maintained when there is no magnetization.

95. The carburetor of claim 71, wherein the control valve of the first fuel system opens a first fuel passage when the actuator is magnetized, and a slightly open state is maintained when there is no magnetization.

96. The carburetor of claim 72, wherein the control valve of the first fuel system opens a first fuel passage when the actuator is magnetized, and a slightly open state is maintained when there is no magnetization.

* * * * *